US006127078A

United States Patent [19]

Omokawa et al.

[11] Patent Number: 6,127,078

[45] Date of Patent: Oct. 3, 2000

[54] ELECTROPHOTOGRAPHIC PHOTOCONDUCTOR AND ELECTROPHOTOGRAPHIC DEVICE USING THE SAME

[75] Inventors: Shinichi Omokawa; Kenichi Ohkura; Seishi Terasaki; Yoshihiro Ueno; Kenji Kawate, all of Kawasaki, Japan

[73] Assignee: Fuji Electric Co., Ltd., Kawasaki, Japan

[21] Appl. No.: 09/477,596

[22] Filed: Jan. 4, 2000

[30] Foreign Application Priority Data

Jan. 7, 1999 [JP] Japan ..... 11-002306

[51] Int. Cl.[7] ..... G03G 5/047

[52] U.S. Cl. ..... 430/58.85; 430/59.5; 399/159

[58] Field of Search ..... 430/58.85, 59.5

[56] References Cited

U.S. PATENT DOCUMENTS 5,736,282 4/1998 Tamura et al. ..... 430/59.5

FOREIGN PATENT DOCUMENTS 62-67094 3/1987 Japan .

4-39667 2/1992 Japan ..... 430/58.85

07271073 10/1995 Japan .

*Primary Examiner*—Roland Martin

*Attorney, Agent, or Firm*—Venable; Robert J. Frank

[57] ABSTRACT

An organic electrophotographic photoconductor diminished in an image trouble due to history of a transfer process in a reversal development system is disclosed. The above organic electrophotographic photoconductor is called a separated-function laminated type organic electrophotographic photoconductor, which has an undercoat layer and a photosensitive layer laminated in this order on a conductive substrate, the photosensitive layer comprising a charge generation layer laminated on the undercoat layer and containing an organic compound, and a charge transport layer laminated on the charge generation layer and containing an organic compound. For the charge generation layer, a titanyloxyphthalocyanine compound is used as a charge generation material. The present invention uses the titanyloxyphthalocyanine compound having a clear diffraction peak at a Bragg angle (2θ) of 9.6°±0.2° or 27.3°±0.2° for CuKα characteristic X-ray (wavelength 1.541 Å). For the charge transport layer, a specific organic compound is used as a charge transport material.

4 Claims, 5 Drawing Sheets

ELECTROPHOTOGRAPHIC PHOTOCONDUCTOR AND ELECTROPHOTOGRAPHIC DEVICE USING THE SAME

This application is based on Patent application No. 11-2306 (1999) filed Jan. 7, 1999 in Japan, the content of which is incorporated, hereinto by reference.

BACKGROUND OF THE INVENTION

1. Field of the Invention

This invention relates to an electrophotographic photoconductor for use in a printer, a copier, or the like of the electrophotographic type. More specifically, the invention relates to an electrophotographic photoconductor and which contains a charge generation material and a charge transport material which assign improved electrophotographic characteristics to the electrophotographic photoconductor. The invention also relates to an electrophotographic device using the electrophotographic photoconductor.

2. Description of the Related Art

An electrophotographic photoconductor (may be referred to hereinafter as a "photoconductor") has a basic structure in which a photosensitive layer having a photoconductive function is laminated on a conductive substrate. In recent years, research and development have been performed energetically of organic electrophotographic photoconductors using organic compounds as functional components engaged in generation and transport of an electric charge. The photoconductors have advantages, such as the diversity of available materials, high productivity, and safety, and their application to copiers or printers is under way.

A photoconductor is required to have the function of retaining a surface charge in the dark, the function of accepting light to generate a charge, and the function of transporting the generated charge. Photoconductors having these functions are classified into a single-layered photoconductor, and a separated-function laminated type photoconductor. Concretely, the single-layered photoconductor allocates all of these functions to a single photosensitive layer. The separated-function laminated type photoconductor, on the other hand, comprises a photosensitive layer which is a laminated structure comprising a charge generation layer mainly responsible for the function of generating a charge upon receiving light, and a charge transport layer with the function of retaining a surface charge in the dark, and the function of transporting the charge generated in the charge generation layer during acceptance of light. The separated-function laminated type photoconductor, in particular, is a separated-function photoconductor comprising the photosensitive layer that is separated to the charge generation layer and the charge transport layer.

Recently, the above-described separated-function laminated type photoconductor using organic compounds has found main use as an electrophotographic photoconductor. The photoconductor has a photosensitive layer formed, for example, in the following manner: An organic pigment as a charge generation material is dissolved or dispersed in an organic solvent together with a resin binder to prepare a coating fluid. The coating fluid is applied as a film to form a charge generation layer. Separately, an organic low molecular compound as a charge transport material is dissolved or dispersed in an organic solvent together with a resin binder to prepare a coating fluid. The coating fluid is applied as a film to form a charge transport layer. These two layers are laminated to form a photosensitive layer.

The current organic photoconductors, however, are not enough to fulfill characteristics required of photoconductors. In particular, equipment of a reversal development system adapted to digitization in recent years is constituted so that primary charging and transfer charging will give opposite polarities. Thus, there occurs the phenomenon that the amount of charging of the photoconductor differs according to the presence or absence of transfer, i.e., a phenomenon called transfer memory. This is an unfavorable phenomenon causing image variations. The equipment of the reversal development system faces the problem that this phenomenon tends to occur. A copier in which transfer voltage is always applied to the photoconductor will be taken as an example for explanation. With such a copier, there are a case in which transfer voltage is applied to the surface of an electrophotographic photoconductor via a fed sheet of paper, and a case in which transfer voltage is applied directly to the surface of an electrophotographic photoconductor in a space between a preceding sheet and a sheet to be fed subsequently (the space is called "the intersheet space"). Thus, the difference in the amount of charging occurs between a photoconductor portion having received transfer voltage via the sheet and a photoconductor portion having directly received transfer voltage in the intersheet space. This difference results in a difference in surface potential during a subsequent charging process, presenting the cause of a change in printing density.

Factors for producing the above-mentioned phenomenon may be as follows: During a transfer process of the photoconductor, the charge transport layer on the surface of the photoconductor is first ionized, and makes hole carriers under the action of an electric field. These hole carriers move from the surface of the charge transport layer into the film under the electric field, and are retained there. The hole carriers in the film move to the surface at the time of a next charging process, canceling out the surface charge, and increasing the printing density.

In response to this problem, a method for improvement has been worked out, such as turning off the transfer voltage in the intersheet space on the machine process side. However, this method involves the problem of leading to a cost increase.

SUMMARY OF THE INVENTION

The present invention has been accomplished in light of the foregoing problems. Its object is to provide an organic electrophotographic photoconductor capable of diminishing an image trouble in a reversal development system.

The present inventors conducted extensive studies in an attempt to solve the above problems, and obtained the following finding: in an electrophotographic photoconductor having a photosensitive layer on a conductive substrate, the photosensitive layer being a laminate of a charge generation layer and a charge transport layer, each layer containing an organic material as main component, a titanyloxyphthalocyanine compound having a specific clear diffraction peak in an X-ray diffraction spectrum is used as a charge generation material in the charge generation layer, and a specific organic compound is used as a charge transport material in the charge transport layer. By using these compounds, the above-mentioned object can be attained.

The present invention relates to a separated-function laminated type organic electrophotographic photoconductor having an undercoat layer, a charge generation layer, and a charge transport layer on a conductive substrate, wherein the charge generation layer contains, as a charge generation material, a titanyloxyphthalocyanine compound of the following general formula (1), (1)

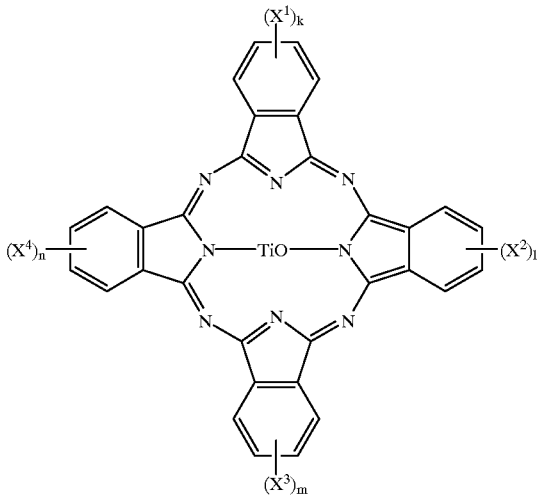

where $X^1$, $X^2$, $X^3$ and $X^4$ may be the same or different, and each represent a halogen atom, and k, l, m and n each represent 0, 1, 2, 3 or 4, the titanyloxyphthalocyanine compound having a clear diffraction peak at a Bragg angle (2θ) of 9.6°±0.2° or 27.3°±0.2° for CuKα characteristic X-ray (wavelength 1.541 Å); and the charge transport layer contains, as a charge transport material, an organic compound of the following general formula (2), (2)

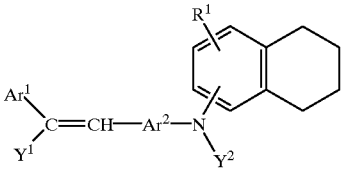

where $Ar^1$ represents an aryl group optionally having a substituent, $Ar^2$ represents an arylene group optionally having a substituent and preferably $Ar^2$ represents a phenylene group, a naphthylene group, a biphenylene group, or an anthrylene group, $R^1$ represents a hydrogen atom, a lower alkyl group, or a lower alkoxy group, $Y^1$ represents a hydrogen atom, an alkyl group optionally having a substituent, or an aryl group optionally having a substituent, and $Y^2$ represents an aryl group optionally having a substituent.

Furthermore, $Y^2$ in the above general formula (2) is preferably selected from:

a group of the formula (3)

(3)

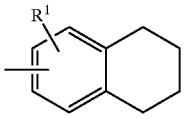

where $R^1$ is the same as defined above;

a group of the formula (4)

(4)

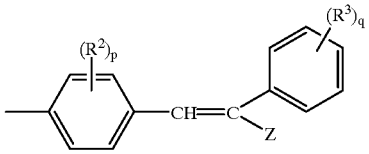

where $R^2$ represents a hydrogen atom, a lower alkyl group, or a lower alkoxy group, $R^3$ represents a hydrogen atom, a halogen atom, or a lower alkyl group, Z represents a hydrogen atom, or an aryl group optionally having a substituent, and p and q each represent 0, 1, 2, 3 or 4; and a group of the formula (5)

(5)

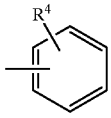

where $R^4$ represents a hydrogen atom, a lower alkyl group, a lower alkoxy group, an alkoxyalkyl group, a halogen atom, an aralkyl group, or an aryl group optionally having a substituent.

The present invention also relates to an electrophotographic device comprising a photoconductor, a charging means, an exposure means, a development means, a transfer means, a fixing means, a pre-exposure means, a cleaning means, and a recording medium supply means, wherein the photoconductor is the photoconductor of the present invention.

The present invention makes it possible to provide an electrophotographic photoconductor which undergoes minimal transfer memory even in a digitization-compatible transfer development system under energetic development in recent years.

The above and other objects, effects, features and advantages of the present invention will become more apparent from the following description of embodiments thereof taken in conjunction with the accompanying drawings.

DETAILED DESCRIPTION OF THE PREFERRED EMBODIMENTS

Figure 1:
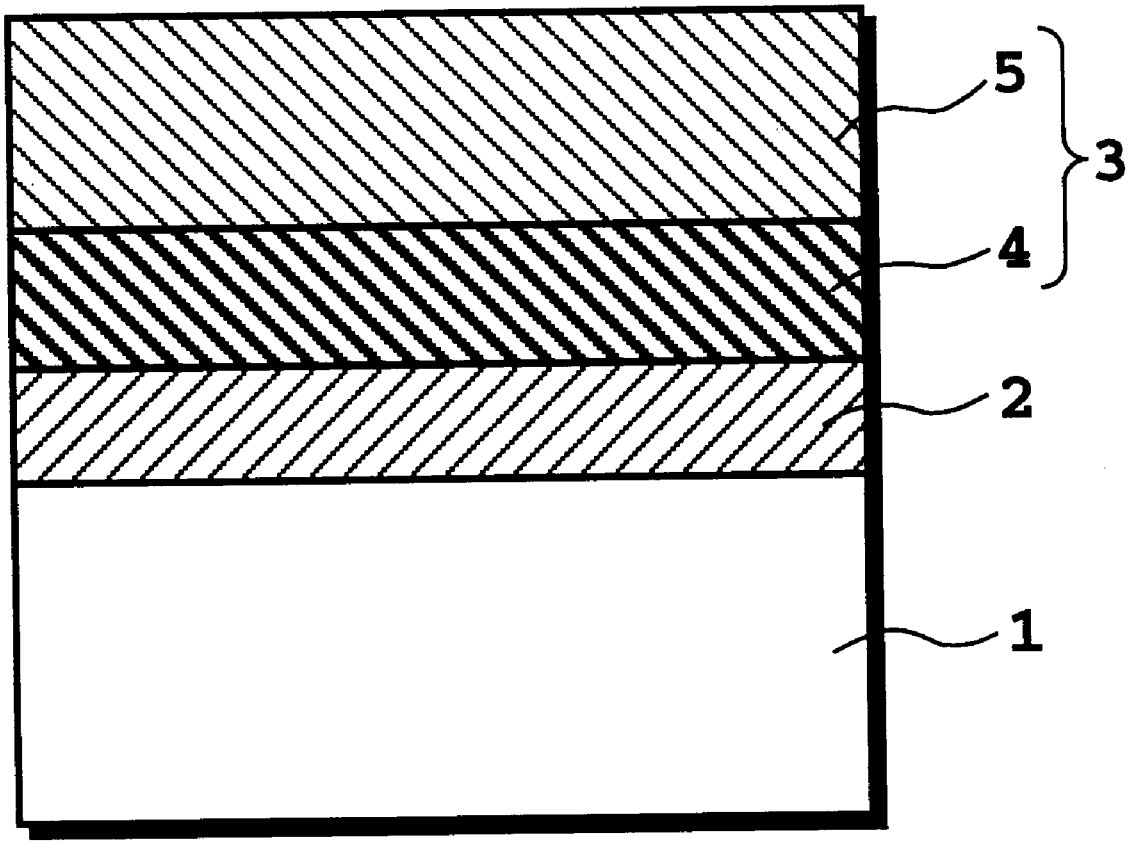
FIG. 1 is a schematic sectional view of a negatively charged, separated-function laminated type electrophotographic photoconductor according to an embodiment of the present invention.

The present invention will now be described in detail below.

The present invention is concerned with a separated-function laminated type organic electrophotographic photoconductor having an undercoat layer and a photosensitive layer laminated in this order on a conductive substrate, the photosensitive layer comprising a charge generation layer laminated on the undercoat layer and containing an organic compound as a main component, and a charge transport layer laminated on the charge generation layer and containing an organic compound as a main component.

In the photoconductor of the invention, specific organic compounds are used as a charge generation material for the charge generation layer, and a charge transport material for the charge transport layer.

The charge generation material of the organic compound as the main component for the charge generation layer is described first.

The charge generation material of the invention is a titanyloxyphthalocyanine compound of the following general formula (1):

(1)

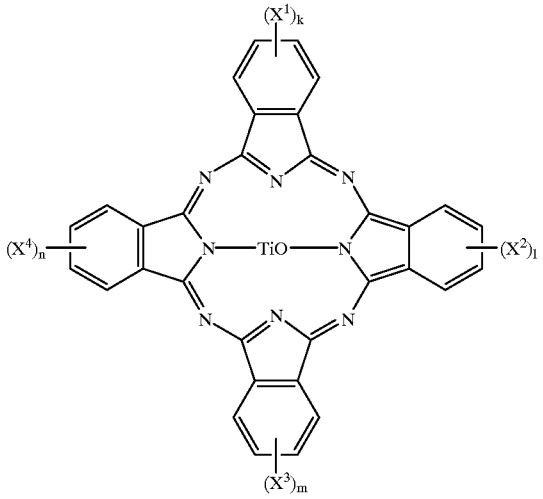

In the invention, titanyloxyphthalocyanine is used which has a clear diffraction peak at a Bragg angle (2θ) of 9.6°±0.2° or 27.3°±0.2° for CuKα characteristic X-ray (wavelength 1.541 Å).

In the formula (1), $X^1$, $X^2$, $X^3$ and $X^4$ may be the same or different, and each represent a halogen atom, preferably a chlorine atom or a bromine atom. k, l, m and n each represent an integer of 0 to 4. Preferably, k, l, m and n each represent 0. This titanyloxyphthalocyanine can be prepared from phthalodinitrile by a conventional method.

Next, a charge transport material usable for the photoconductor of the present invention is described.

As the charge transport material of the organic compound as the main component for the charge transport layer, a compound of the following general formula (2) is used:

(2)

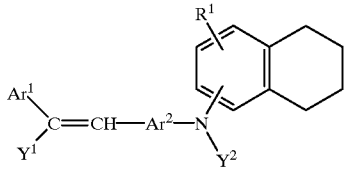

In the invention, $Ar^1$ represents an aryl group which may have a substituent. Its example is an aromatic compound, such as a monocyclic aromatic compound, a polycyclic aromatic compound, or a fused ring aromatic compound. Preferably, a phenyl group, a substituted phenyl group, a naphthyl group, a substituted naphthyl group, an anthryl group, or a pyrenyl group can be exemplified as $Ar^1$. As the substituent, a halogen atom, an alkyl group, a cycloalkyl group, an alkoxyalkyl group, an alkoxy group, or an aralkyl group can be exemplified. More preferably, the halogen atom is chlorine; the alkyl group is a straight chain or branched chain lower alkyl group, for example, methyl, ethyl, propyl, n-butyl, sec-butyl, t-butyl, pentyl, or hexyl; the cycloalkyl group is cyclohexyl; the alkoxyalkyl group may have the carbon chain branched and the represent, for example, methoxymethyl, ethoxymethyl, or ethoxyethyl; the alkoxy group is a lower alkoxy group, for example, methoxy, ethoxy, propoxy, isopropoxy, n-butoxy, or t-butoxy; and the aralkyl group is a benzyl group. One or more of the substituents may be involved in $Ar^1$. If a plurality of the substituents are present, these substituents may be the same or different.

$Ar^2$ represents an arylene group which may have a substituent. Preferably, $Ar^2$ represents a phenylene group, a naphthylene group, a biphenylene group, or an anthrylene group. The substituent on $Ar^2$ is the same as described in connection with $Ar^1$. The most preferable substituent on $Ar^2$ is an alkyl group or an alkoxy group. One or more of the substituents may be involved in $Ar^2$. If a plurality of the substituents are present, these substituents may be the same or different.

$R^1$ represents a hydrogen atom, a lower alkyl group, or a lower alkoxy group, for example, methyl, ethyl, propyl, n-butyl, sec-butyl, t-butyl, pentyl, or hexyl, methoxy, ethoxy, propoxy, isopropoxy, n-butoxy, or t-butoxy. Preferably, $R^1$ is hydrogen atom.

$Y^1$ represents a hydrogen atom, an alkyl group optionally having a substituent, or an aryl group optionally having a substituent. The substituent is the same as described in connection with $Ar^1$. Preferably, $Y^1$ is hydrogen atom, methyl, ethyl, phenyl, or 4-methylphenyl. One or more of the substituents may be involved in $Y^1$. If a plurality of the substituents are present, these substituents may be the same or different.

$Y^2$ represents an aryl group optionally having a substituent. The aryl group is the same as the aryl group described in connection with $Ar^1$, but also includes a group represented by the following general formula (3) or (4):

(3)

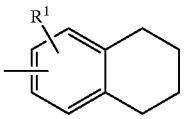

(4)

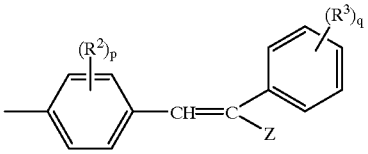

In the present invention, $R^1$ is as defined above, $R^2$ represents a hydrogen atom, a lower alkyl group, or a lower alkoxy group, $R^3$ represents a hydrogen atom, a halogen atom, or a lower alkyl group, Z represents a hydrogen atom, or an aryl group optionally having a substituent, and p and q each represent an integer of 0 to 4. In the above general formulae (3) and (4), the halogen atom, the lower alkoxy group, the lower alkyl group, and the aryl group optionally having a substituent are as defined earlier in connection with the general formula (2).

In the general formula (2), $Y^2$ is preferably represented by the general formula (3)

(3)

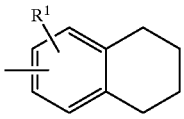

or represented by the general formula (4)

(4)

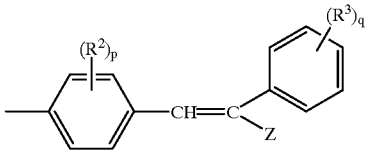

or represented by the general formula (5)

(5)

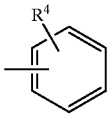

In the present invention, $R^4$ represents a hydrogen atom, a lower alkyl group, a lower alkoxy group, an alkoxyalkyl group, a halogen atom, an aralkyl group, or an aryl group optionally having a substituent. Examples of these groups are as described in connection with the general formula (2).

As the compound of the general formula (2) that is used in the invention, the following compounds can be exemplified, but this compound is not restricted thereto:

(2-1)

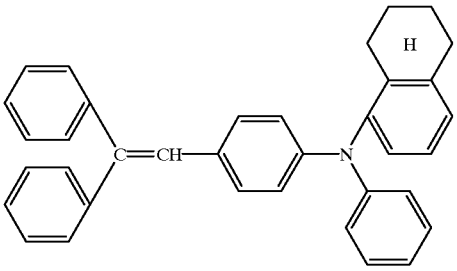

(2-2)

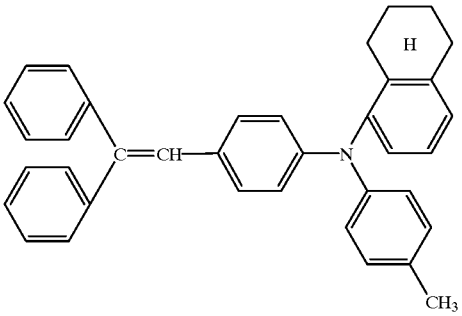

-continued
(2-3)
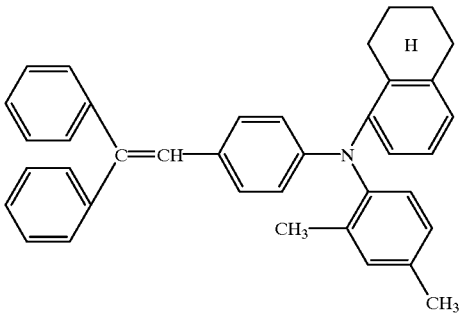
(2-4)
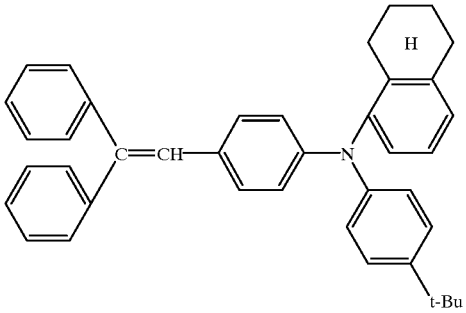
(2-5)
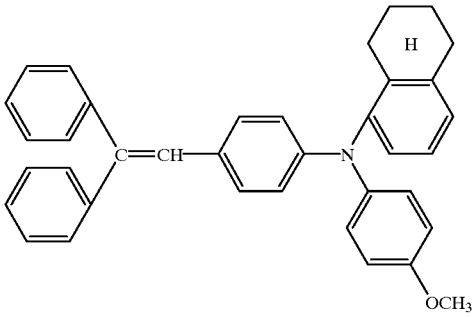
(2-6)
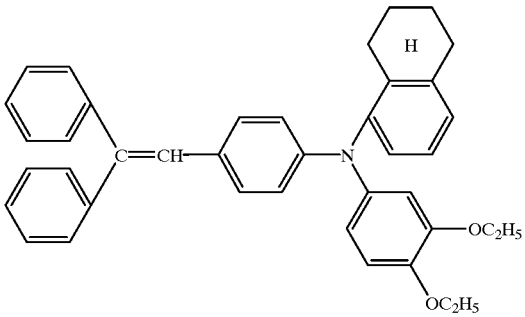

-continued
(2-7)
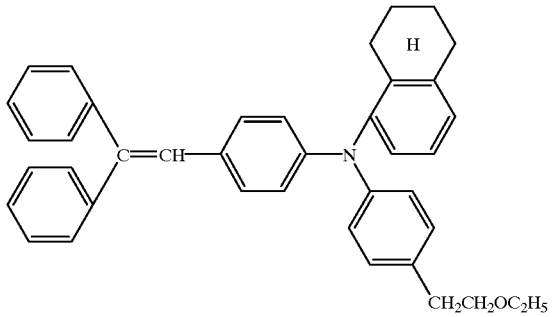
(2-8)
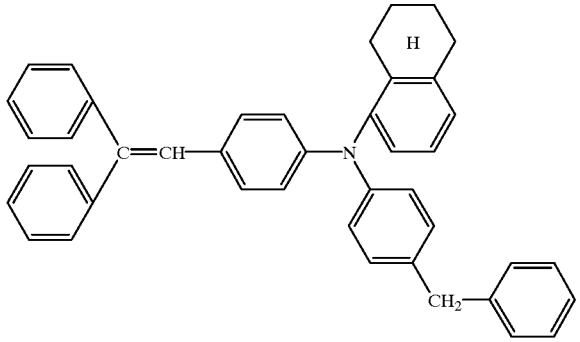
(2-9)
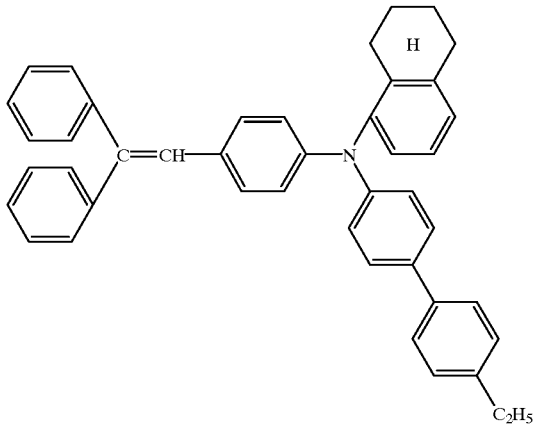
(2-10)
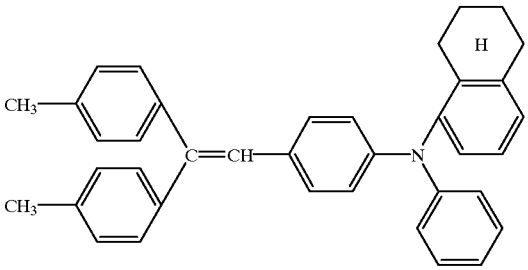

-continued
(2-11)
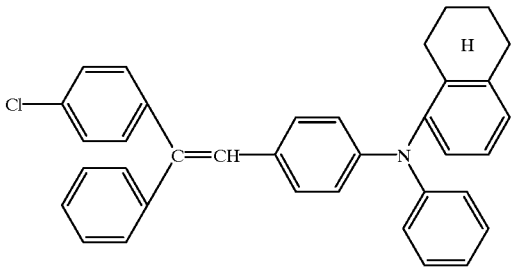
(2-12)
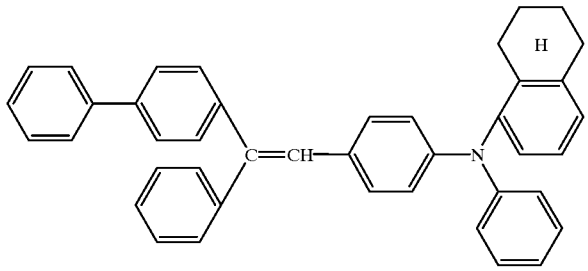
(2-13)
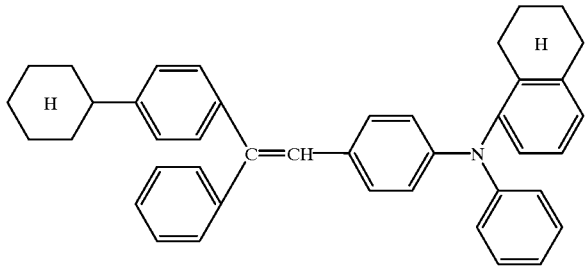
(2-14)
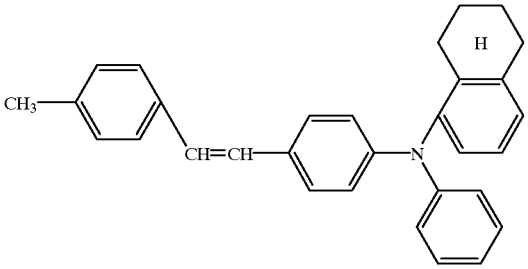
(2-15)
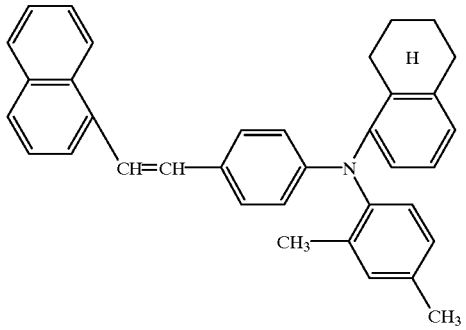

-continued
(2-16)
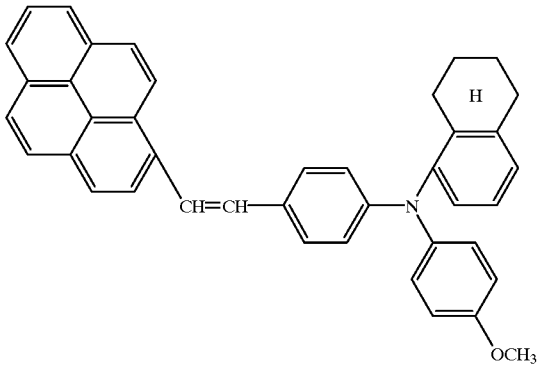
(2-17)
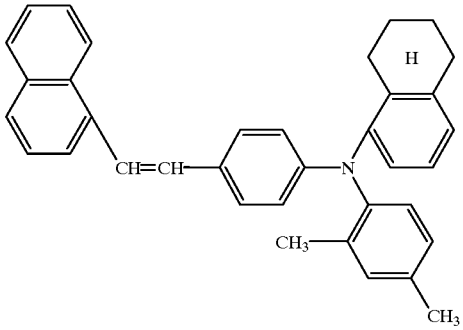
(2-18)
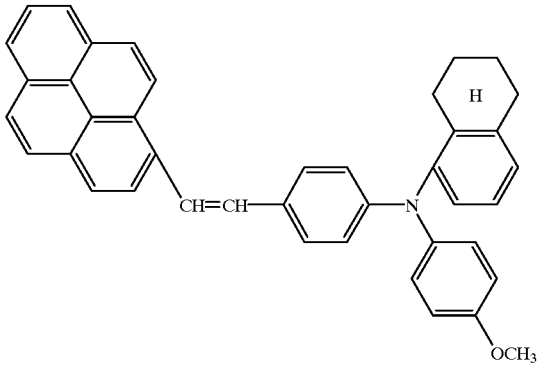
(2-19)
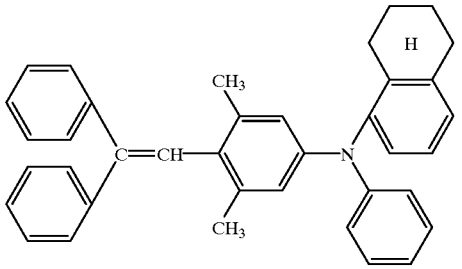

-continued
(2-20)
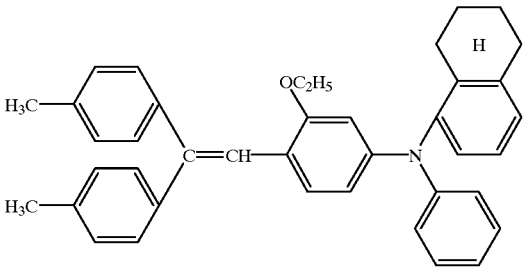
(2-21)
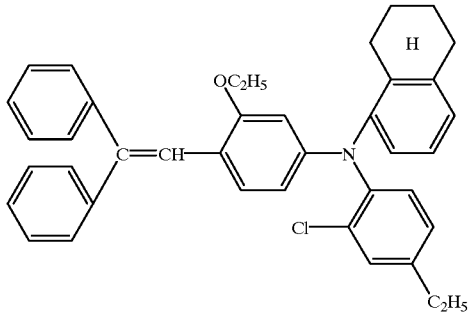
(2-22)
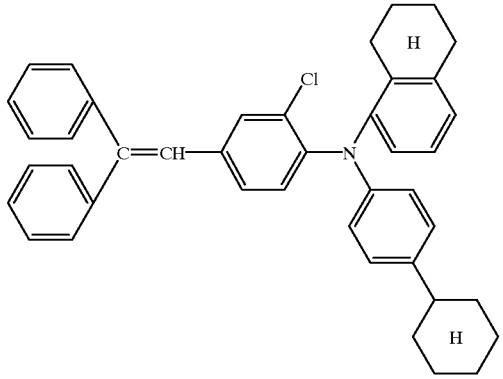
(2-23)
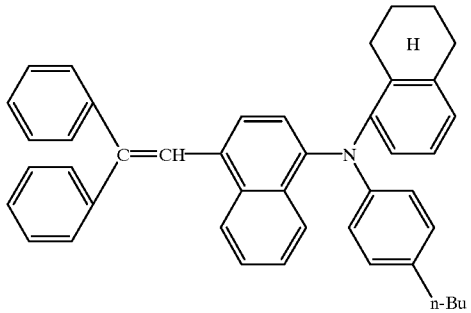

-continued
(2-24)
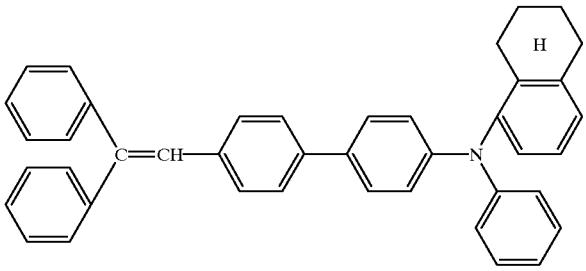
(2-25)
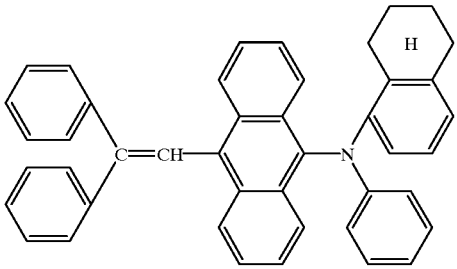
(2-26)
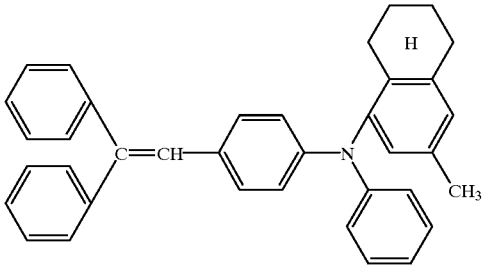
(2-27)
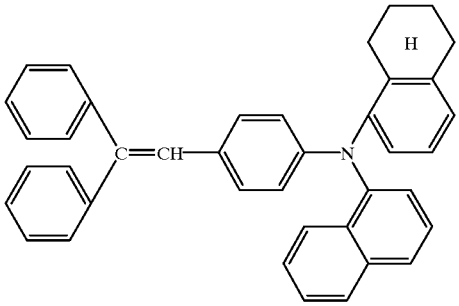
(2-28)
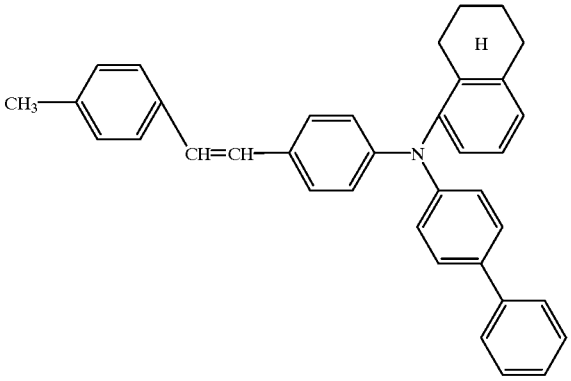

-continued
(2-29)
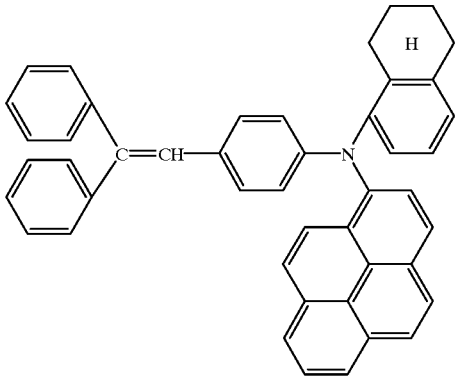
(2-30)
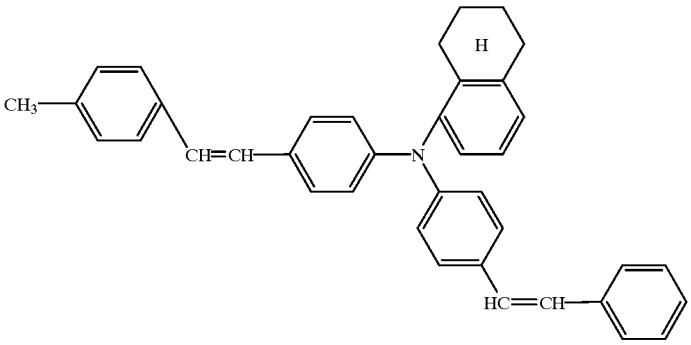
(2-31)
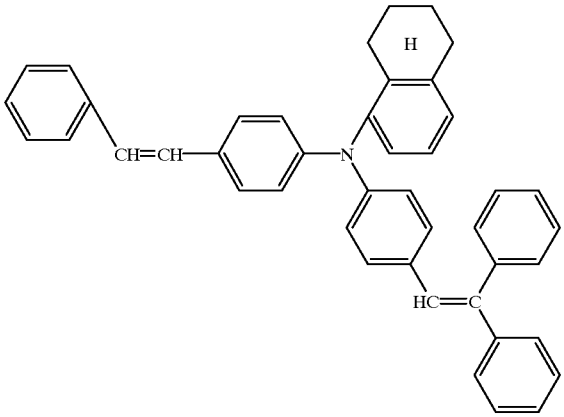
(2-32)
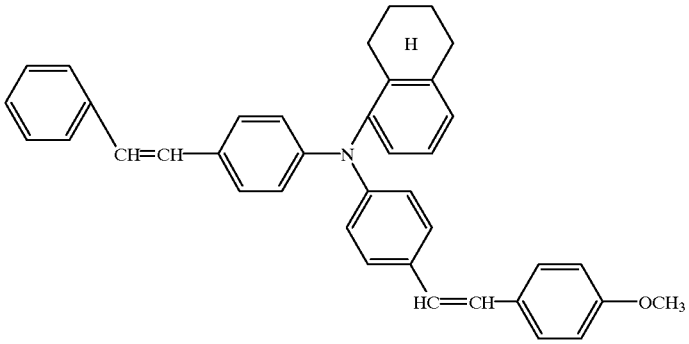

-continued
(2-33)
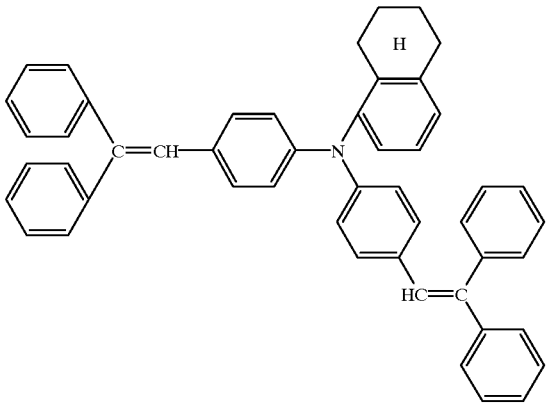
(2-34)
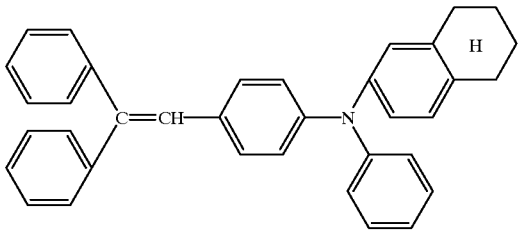
(2-35)
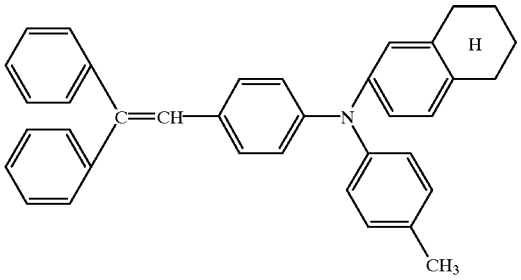
(2-36)
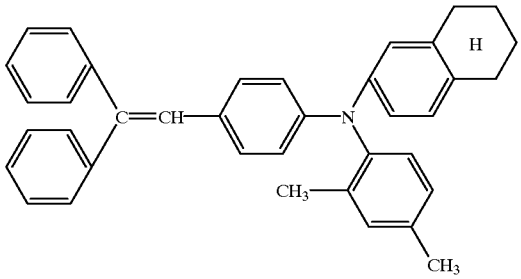
(2-37)
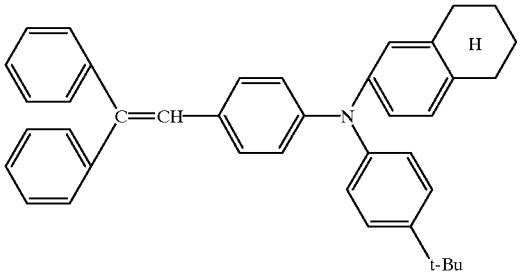

-continued
(2-38)
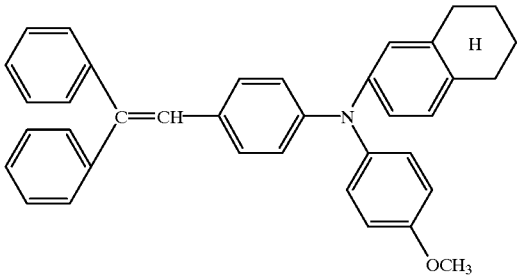
(2-39)
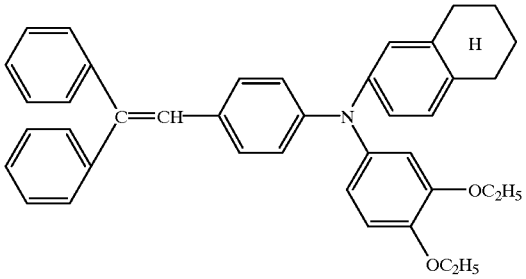
(2-40)
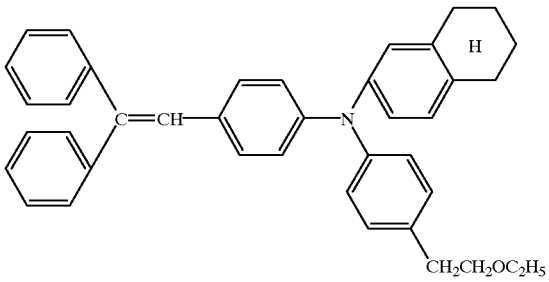
(2-41)
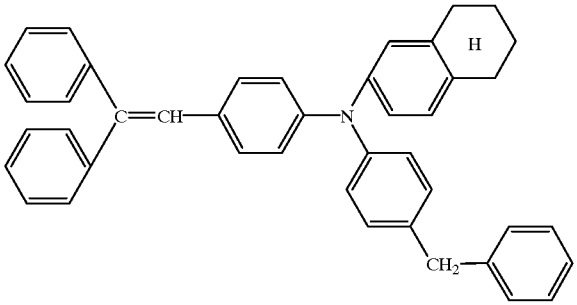
(2-42)
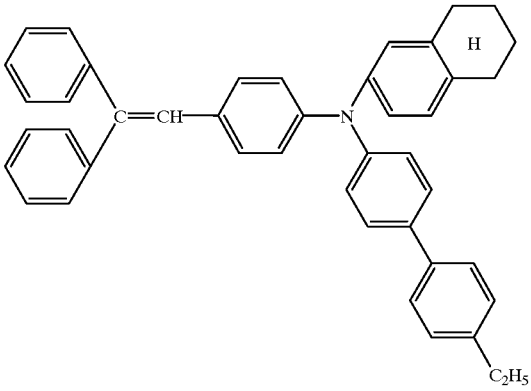

-continued
(2-43)
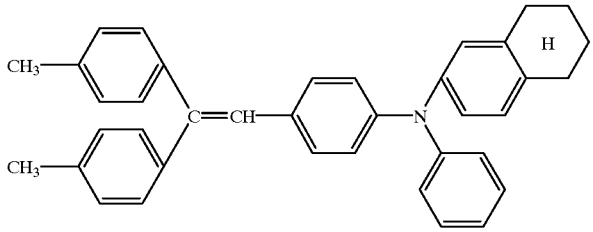
(2-44)
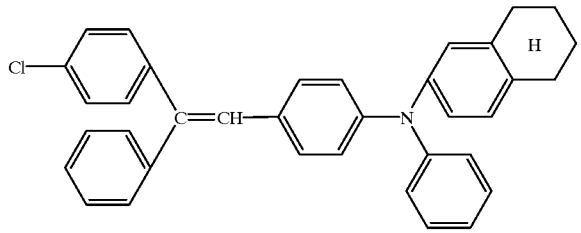
(2-45)
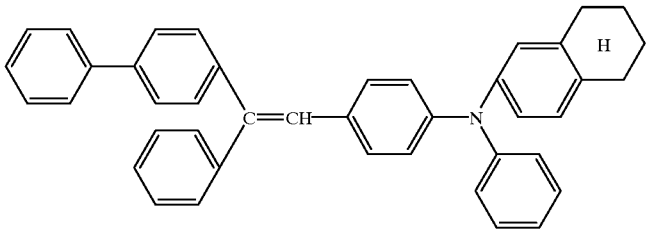
(2-46)
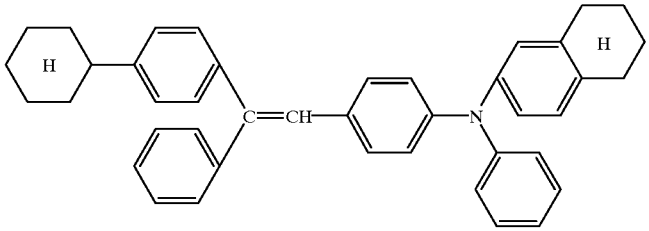
(2-47)
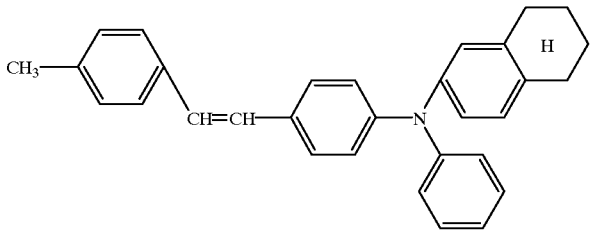
(2-48)
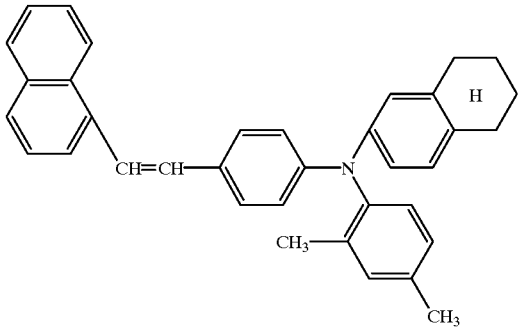

-continued
(2-49)
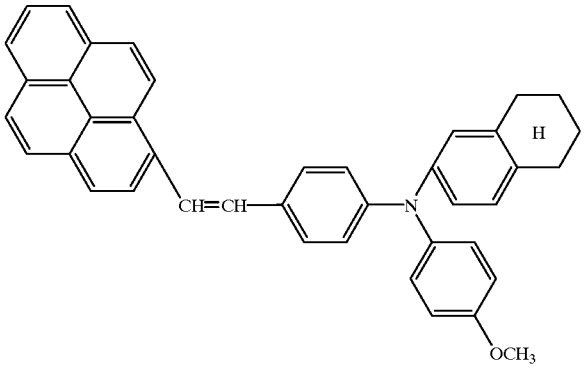
(2-50)
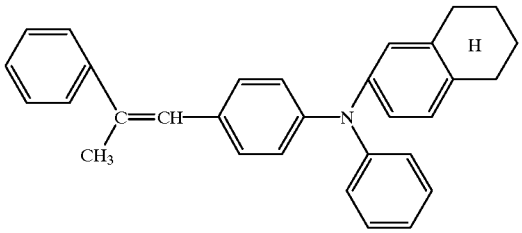
(2-51)
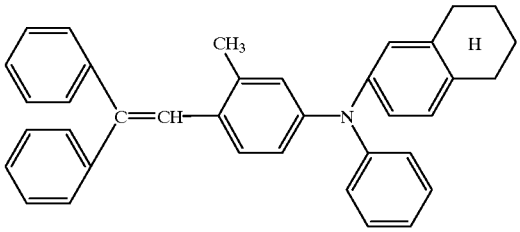
(2-52)
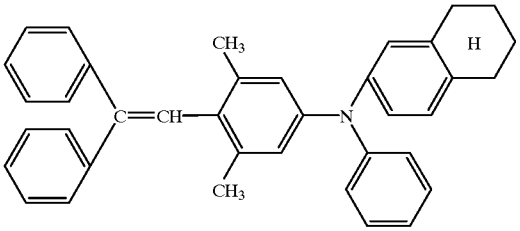
(2-53)
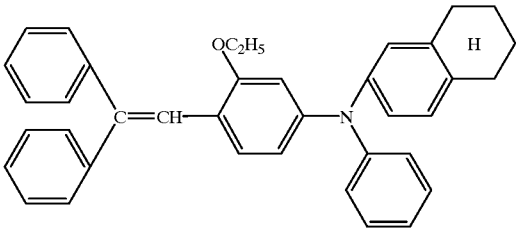

-continued
(2-54)
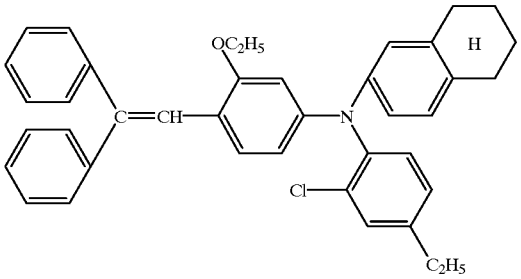
(2-55)
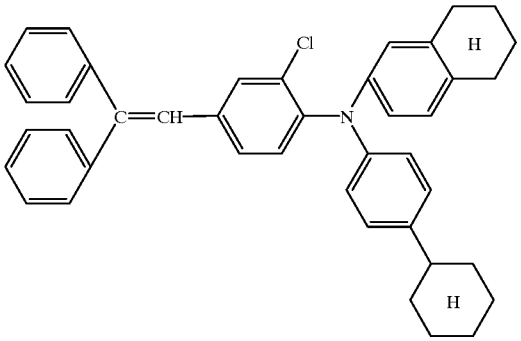
(2-56)
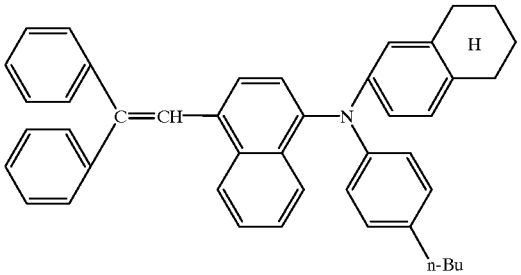
(2-57)
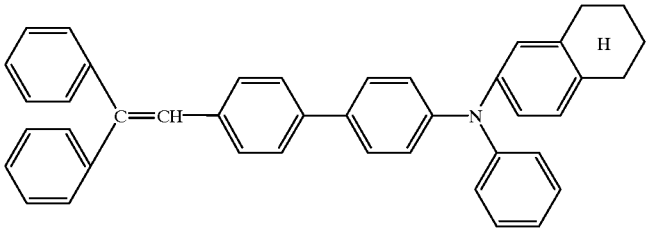
(2-58)
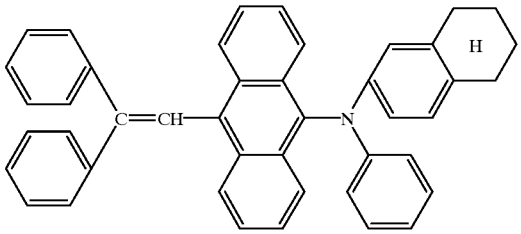

-continued
(2-59)
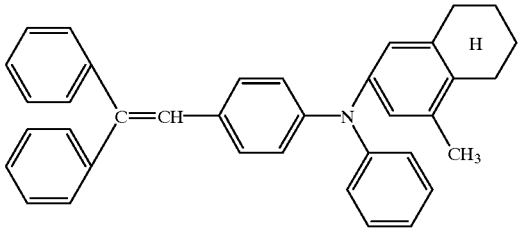
(2-60)
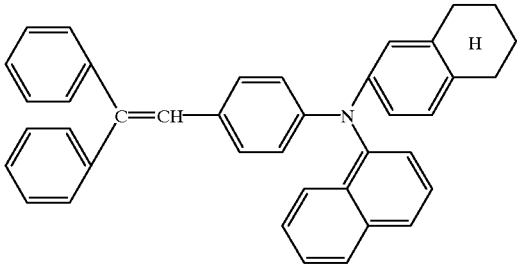
(2-61)
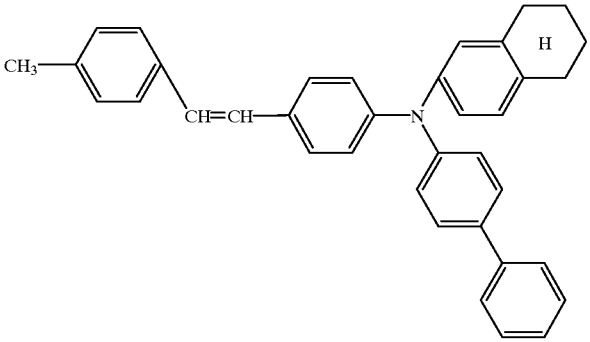
(2-62)
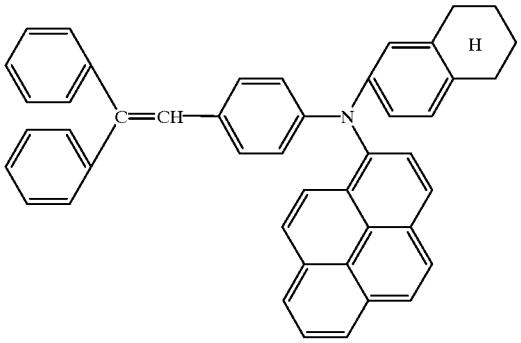
(2-63)
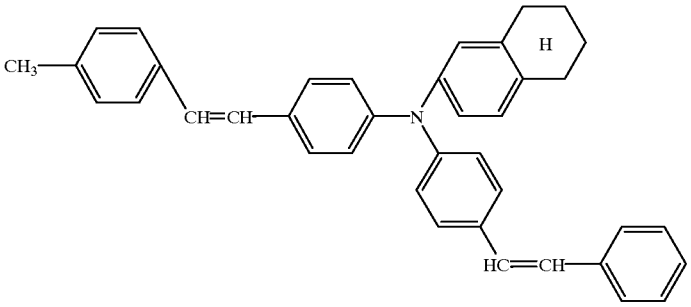

-continued
(2-64)
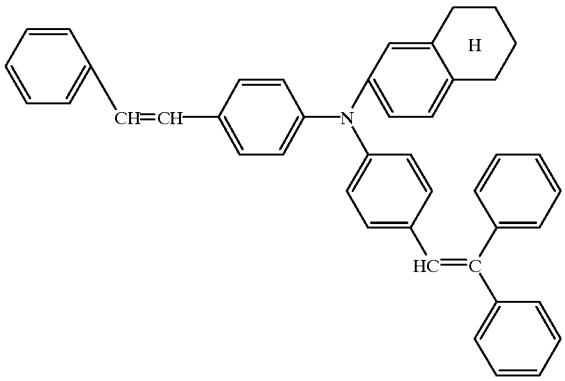
(2-65)
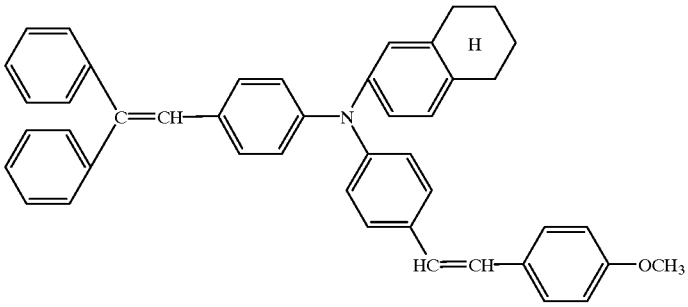
(2-66)
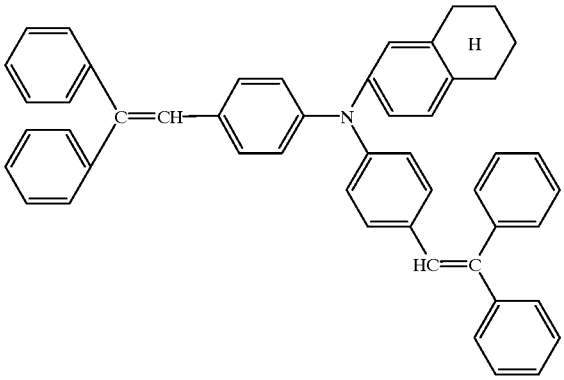
(2-67)
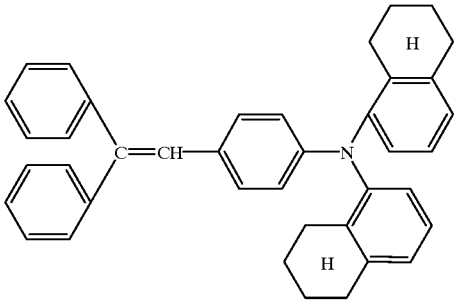

-continued (2-68)

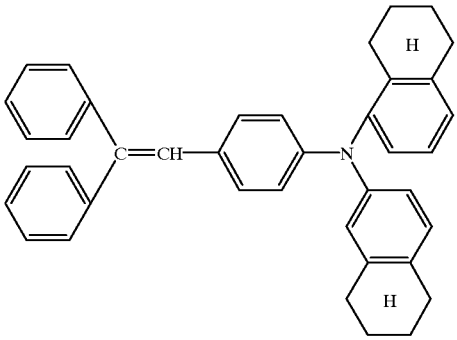

(2-69)

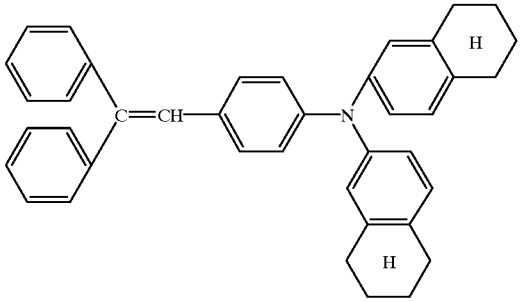

(2-70)

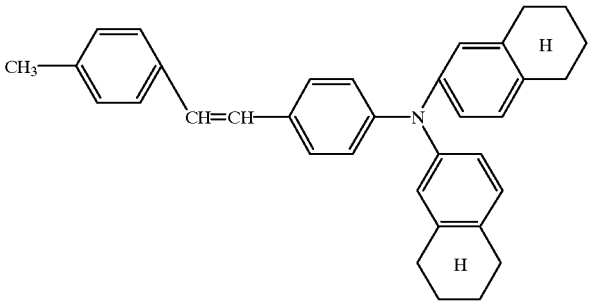

Next, the photoconductor of the present invention will be described.

FIG. 1 is a schematic sectional view showing an embodiment of the photoconductor of the invention. The photoconductor of the invention in FIG. 1 comprises, as constituent elements, a conductive substrate 1, an undercoat layer 2, and a photosensitive layer 3 consisting of a charge generation layer 4 and a charge transport layer 5. The photoconductor of this example is a negatively charged, separated-function laminated type photoconductor. In this invention, the undercoat layer 2 is an arbitrary element, and may be or need not be provided to the photoconductor, depending on the purpose of the photoconductor.

The photoconductor of the invention is produced by laminating these constituent elements sequentially. The method for production may be any method for producing a separated-function laminated type electrophotographic photoconductor. The method includes a general coating or printing methods. For example, the method includes, but is not limited to, dip coating, spray coating, spin coating, knife coating, curtain flow coating, roll coating or the like.

The respective constituent elements will be described below.

The conductive substrate 1 has the role of an electrode for the photoconductor, and the function of a support for the respective layers constituting the photoconductor. The conductive substrate 1 may be in any shape, for example, cylindrical, plate-like, or film-like, depending on the purpose of use. A metal, such as aluminum, stainless steel, or nickel, or a material, such as glass or resin whose surface has been treated to have electrical conductivity, can be used as the conductive substrate 1. In the present invention, a metal such as aluminum is particularly preferred.

The undercoat layer 2 may be provided, if necessary. The undercoat layer 2 can be a layer comprising resin as a main component, or a metal oxide film such as Alumite. This undercoat layer 2 is provided, where necessary, in order to control injection of a charge from the conductive substrate 1 into the photosensitive layer 3, or for a purpose, such as coating of defects in the surface of the conductive substrate 1, or enhancement of adhesion between the photosensitive layer 3 and the conductive substrate 1. When the layer comprising resin as the main component is used as the undercoat layer 2, the materials for the resin include, for example, insulating polymers such as casein, polyvinyl alcohol, polyamide, melamine, and cellulose, and conductive polymers such as polythiophene, polypyrrole, and polyaniline. These resins can be used alone or in a suitable combination. Metal oxides, such as titanium dioxide and zinc oxide, may be added to these resins. These necessary components are suitably kneaded to prepare a material for the undercoat layer 2.

When a metal oxide film is used as the undercoat layer 2, the metal oxide film is formed, for example, by electrode oxidation, such as anodic oxidation, of the conductive substrate 1, such as a substrate of aluminum.

The charge generation layer 4 comprises an organic charge generation material and a resin binder. In the present invention, a titanyloxyphthalocyanine compound of the aforementioned general formula (1), which has a clear diffraction peak at a Bragg angle (2 θ) of 9.6°±0.2° or 27.3°±0.2° for CuKα as a radiation source, is used as the charge generation material. The amount of such a titanyloxyphthalocyanine compound used is 5 to 500 parts by weight, preferably 10 to 100 parts by weight, for 10 parts by weight of the resin binder. Examples of the resin binder include polyvinylbutyral resin, polyvinyl formal resin, vinyl chloride-vinyl acetate copolymer, and polyester resin. Particularly, polyvinylbutyral resin is preferred. Furthermore, the charge generation layer 4 has the charge transport layer 5 laminated on top of it. Thus, the thickness of the charge generation layer 4 is determined by the optical absorption coefficient of the charge generation substance, and it is generally 5 μm or less, preferably 1 μm or less. In the present invention, the compound of the general formula (1) and the resin are dissolved or dispersed in a suitable solvent such as dichloromethane, trichloroethane, tetrahydrofuran, dioxane, 1,3-dioxolan and the like to prepare a coating fluid. The coating fluid is applied, for example, by dip coating to form a film on the undercoat layer 2.

The charge transport layer 5 comprises a charge transport material and a resin binder. In the present invention, an organic compound of the aforementioned general formula (2) is used as the charge transport material. The amount of such an organic compound used is 10 to 200 parts by weight, preferably 70 to 150 parts by weight, for 100 parts by weight of the resin binder. Examples of the resin binder include polycarbonate resins, such as bisphenol A type resin, bisphenol Z type resin, and bisphenol A-biphenyl copolymer, polystyrene resins, and polyphenylene resins. These resins can be used alone or in a suitable combination. The thickness of the charge transport layer 5 is preferably 3 to 50 μm, more preferably 15 to 40 μm, in order to maintain a surface potential effective for practical use. In the present invention, the compound of the general formula (2) and the resin are dissolved or dispersed in a suitable solvent such as dichloromethane, trichloroethane, tetrahydrofuran, dioxane, 1,3-dioxolan and the like to prepare a coating fluid. The coating fluid is applied, for example, by dip coating to form a film on the charge generation layer 4.

In the invention, an electron accepting substance, an antioxidant, a light stabilizer, etc. can be added, where necessary, to the undercoat layer 2 and/or the charge transport layer 5, in order to increase sensitivity, decrease residual potential, or enhance environmental resistance or stability against noxious light. Examples of compounds used for these purposes are, but not restricted to, chromanol derivatives such as tocopherols, ether compounds, ester compounds, polyarylalkane compounds, hydroquinone derivatives, diether compounds, benzophenone derivatives, benzotriazole derivatives, thioether compounds, phenylenediamine derivatives, phosphonic esters, phosphorous esters, phenolic compounds, hindered phenolic compounds, straight chain amine compounds, cyclic amine compounds, and hindered amine compounds.

The photosensitive layer 3 may also contain leveling agents, such as silicone oils or fluorine-derived oils, with the aim of improving the leveling properties of the resulting film, and imparting further lubricating properties.

For the purpose of enhancing environmental resistance and mechanical strength, a surface protecting layer may be provided, if desired, on the surface of the photosensitive layer 3. The surface protecting layer is formed by a material excellent in durability to mechanical stress and in environmental resistance. For example, the following materials can be used, but not limited to: polyvinylbutyral resin, polycarbonate resin, nylon resin, polyurethane resin, polyarylate resin, modified silicon resin such as acryl-modified silicon resin, epoxy-modified silicon resin, alkyd-modified silicon resin, polyester-modified silicon resin, urethane-modified silicon resin and the like, and silicon resin as hard coating agent. In such materials, the modified silicon resin can be used alone or combination thereof. Preferably, to improve durability, the modified silicon resin is mixed with a condensate of a metal alkoxy compound which form a film containing $SiO_2$, $In_2O_3$, or $ZrO_2$ as main component. The surface protecting layer may contain an orange dye. The material for the surface protecting layer, desirably, has the property of allowing transmission, with a minimal loss, of light which the charge generation layer 4 is susceptible to.

Next, an electrophotographic device using the photoconductor of the present invention will be described with reference to FIG. 2.

Figure 2:
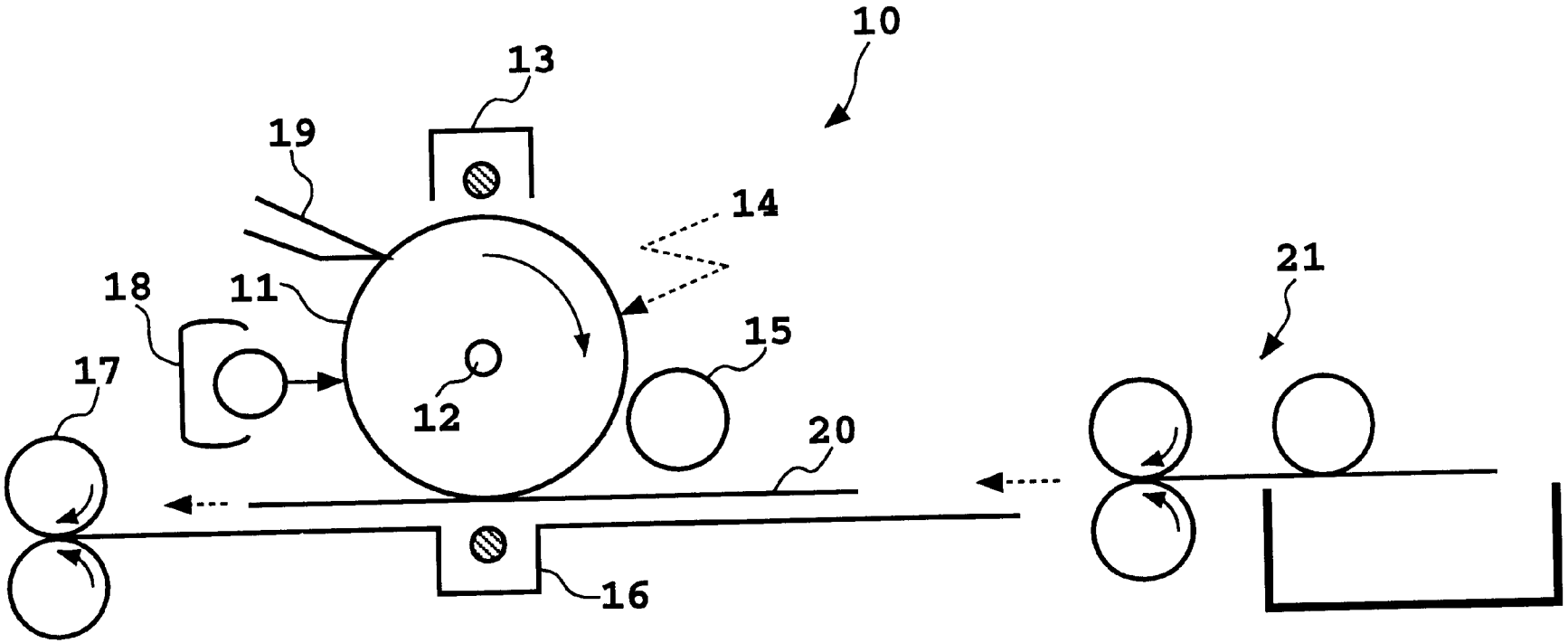
FIG. 2 is a schematic view showing an essential part of an exemplary transfer-based electrophotographic device having the electrophotographic photoconductor of the present invention installed therein.

FIG. 2 is a schematic view of a transfer type electrophotographic device using the electrophotographic photoconductor of the present invention. FIG. 2 is given only for the purpose of illustration, and the electrophotographic device of the invention may be any electrophotographic device using a separated-function laminated type electrophotographic photoconductor.

The device of the present invention comprises a cylinder type photoconductor 11 of the invention having a shaft 12, a charging means 13 such as a primary charger, an electrostatic latent image forming means provided with an exposure means 14 for projecting an image onto the photoconductor to form an electrostatic latent image, a development means 15 for adhering colored charged particles, such as toner, to the electrostatic latent image to make this image visible, a transfer means 16 for transferring the image onto a recording medium such as a transfer sheet, a fixing means 17 for fixing a charged colored resin, such as toner, to the recording medium, a pre-exposure means 18 for erasing a residual latent image on the photoconductor, a cleaning means 19 for removing the remaining colored charged particles, and a supply means 21 for supplying a recording medium 20 such as a sheet of paper. These means of the device according to the present invention are arranged in the same manner as in an ordinary electrophotographic device.

The cylinder type photoconductor 11 of the invention is rotationally driven about the shaft 12 by a driving means (not shown), such as a motor, at a predetermined peripheral speed in the direction of an arrow. The photoconductor 11 normally undergoes negative charging by the charging means 13 onto its surface during its rotating process. Then, the photoconductor 11 undergoes optical image-wise exposure by the exposure means 14 using means such as slit exposure or laser scanning exposure, whereby an electrostatic latent image is formed on the surface of the photoconductor. The electrostatic latent image formed on the surface further undergoes toner development by the development means 15. Then, transfer of a polarity opposite to the polarity applied at the time of charging is performed for the resulting toner image by the transfer means 16. As a result, the image is transferred onto the surface of the recording medium 20 which has been fed by the feeding means 21 to the gap between the photoconductor 11 and the transfer means 16. The recording medium 20 having undergone transfer of the toner image is introduced to the fixing means 17, where it undergoes image fixing, and is then delivered to the outside of the device as a copy. The surface of the photoconductor 11 after image formation is subjected to static elimination by the pre-exposure means 18, and to removal of the untransferred toner by the cleaning means 19, so that the photoconductor 11 is used repeatedly for image formation.

The electrophotographic photoconductor of the present invention can be used not only for the foregoing copier, but can also be used widely for fields of application of electrophotography, such as laser beam printer and LED printer.

EXAMPLES

The present invention will now be described by way of the following Examples.

First, examples of synthesis of titanyloxyphthalocyanine used in the Examples are described. In these examples, the parts are parts by weight, and % is % by weight.

Synthesis Example 1

A 2-liter four-necked flask equipped with a stirrer and a cooler was loaded with 128 parts of phthalodinitrile, and to this flask, 1,000 parts of quinoline was added, followed by adding 47.5 parts of titanium tetrachloride dropwise under a nitrogen atmosphere. After dropwise addition, the temperature was raised, and the mixture was reacted for 8 hours at 200° C.±10° C. Then, the system was allowed to cool, filtered at 130° C., and washed with 500 parts of quinoline heated at 130° C. Further, the filter cake was thoroughly washed with N-methyl-2-pyrrolidone heated at 130° C. until the filtrate became clear. Then, the wet cake was washed with methanol and water in this order, and washed until the wet cake contained no solvent. The resulting wet cake was dispersed in 1,000 parts of a 3% aqueous solution of sodium hydroxide, and the dispersion was heated for 4 hours. Then, the dispersion was filtered, and the filter cake was washed with water until the filtrate became neutral. Then, the resulting cake was dispersed in 1,000 parts of a 3% aqueous solution of hydrochloric acid. After heating for 4 hours, the dispersion was filtered, and the filter cake was washed with water until the filtrate became neutral. Furthermore, the substance on the filter paper was washed with methanol and acetone. This alkali-acid-methanol-acetone purification procedure was repeated several times until the filtrate after washing with methanol and acetone became completely colorless. Then, the resulting product was dried. The yield of the product was 101.2 parts. FDMS analysis of the thus obtained titanyloxyphthalocyanine showed only a single peak at 576 corresponding to the molecular weight of titanyloxyphthalocyanine. This finding demonstrated the product to be titanyloxyphthalocyanine without impurities.

Figure 3:
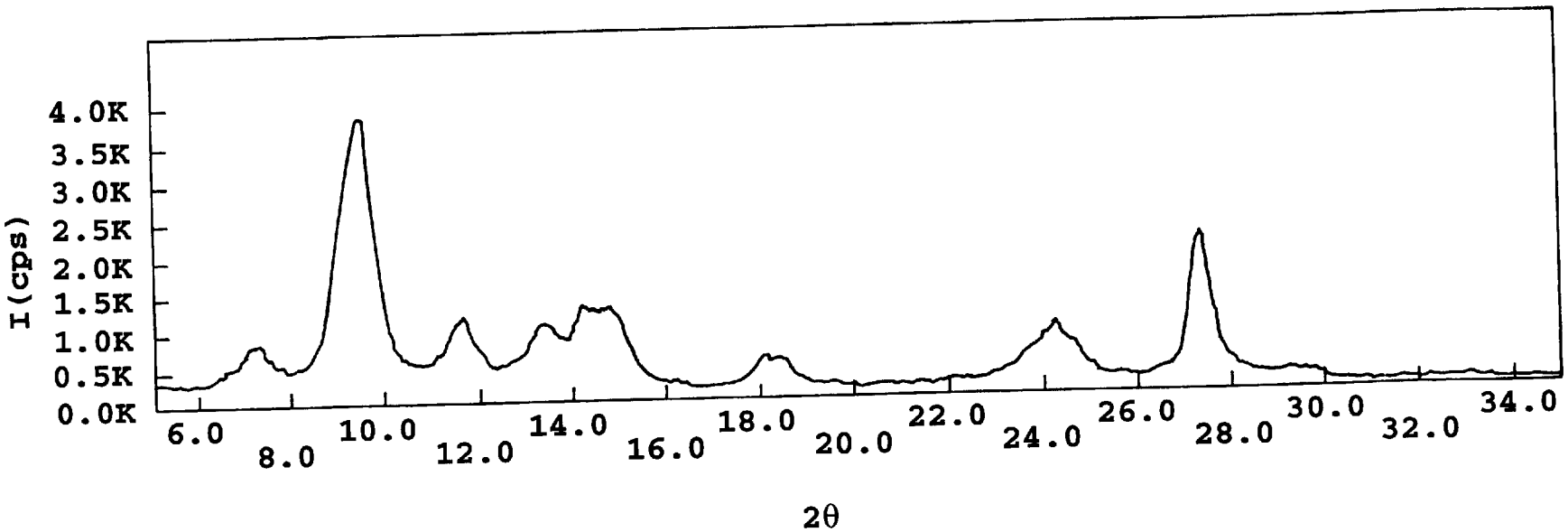
FIG. 3 shows the X-ray diffraction spectrum of titanyloxyphthalocyanine crystals described in Example 1.

The resulting titanyloxyphthalocyanine (50 parts) was slowly added, with stirring, to 750 parts of concentrated sulfuric acid cooled to −10° C. or lower. The addition was carried out, with cooling being performed such that the fluid temperature did not become −5° C. or higher. This fluid was further stirred for 2 hours, and then added dropwise into iced water at 0° C. A precipitated blue substance was filtered off, and washed with water. The resulting cake was dispersed in 500 parts of a 2% aqueous solution of sodium hydroxide, and heated. Then, the mixture was filtered, and the filter cake was washed with water until the filtrate became completely neutral, whereafter the cake was dried. A mixture of 40 parts of the resulting amorphous titanyloxyphthalocyanine, 100 parts of sodium chloride, and 400 parts of water was formed into fine particles for 3 hours at room temperature in a zirconia beads-loaded sand mill ("Tynomill", Sinmaru Enterprises). Then, 200 parts of dichlorotoluene was added, and operation of the sand mill was continued. During operation, titanyloxyphthalocyanine gradually moved from the aqueous phase into the oil phase. Water being separated in this process was removed, and during this period, formation into fine particles was performed for 3 hours. Then, the contents were withdrawn, and dichlorotoluene was distilled off by steam distillation. The remaining titanyloxyphthalocyanine was filtered with water, and then dried. The X-ray diffraction spectrum of the resulting titanyloxyphthalocyanine is shown in FIG. 3.

Figure 4:
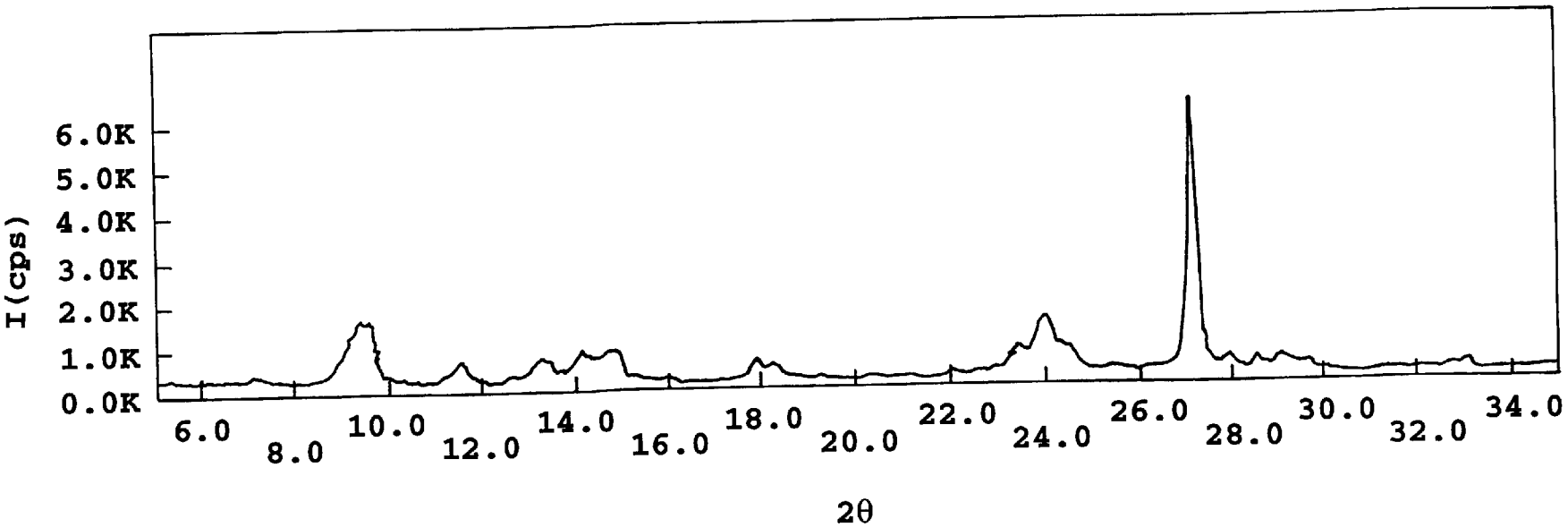
FIG. 4 shows the X-ray diffraction spectrum of titanyloxyphthalocyanine crystals described in Example 2.

Synthesis Example 2

α-type titanyloxyphthalocyanine (10 parts) prepared according to the method disclosed in Japanese Patent Application Laid Open No. 7-271073 which is incorporated herein by reference, 5 to 20 parts of sodium chloride as a grinding assistant, and 10 parts of polyethylene glycol as a dispersion medium were placed in a sand grinder, and ground for 7 to 15 hours at 60 to 120° C. The mixture was withdrawn from the container, and the grinding assistant and the dispersion medium were removed using water and methanol. Then, the product was purified with a 2% aqueous solution of diluted sulfuric acid. The resulting product was filtered, washed with water, and dried to give clear greenish blue crystals. The X-ray diffraction spectrum of the resulting titanyloxyphthalocyanine is shown in FIG. 4.

Example 1

An electrode oxidation film as an undercoat layer was formed on an outer peripheral surface of a cylindrical substrate of aluminum as a conductive substrate. The way of forming the electrode oxidation film was as follows: The cylindrical substrate of aluminum was washed for degreasing, and was then subjected to anodic oxidation (current density 1.0 A/dm$^2$, bath voltage 13.5 to 14.0 V) in sulfuric acid (180 g, 10 to 20° C., 25 minutes) to form a 7 μm electrode oxidation film.

Sealing treatment was performed at 70° C. using pure water (ion-exchanged water). Then, the composite was ultrasonically washed twice with hot pure water and twice with pure water, and dried with hot air to form an undercoat layer comprising the anodic oxidation film.

On this undercoat layer, a coating fluid prepared by a method to be described below was applied by dip coating, and dried for 30 minutes at a temperature of 80° C. to form a charge generation layer with a thickness of about 0.3 μm.

For the coating fluid, titanyloxyphthalocyanine synthesized in the Synthesis Example 1 and having the X-ray diffraction spectrum shown in FIG. 3 (maximum peak at 2θ±9.6°±0.2°) was used as a charge generation material. This titanyloxyphthalocyanine (1 part by weight) and 1.5 parts by weight of a special vinyl chloride copolymer ("MR-110", Nippon Zeon) as a resin binder were added to 60 parts by weight of dichloromethane, and these materials were mixed together to prepare a coating fluid.

On the resulting charge generation layer, a charge transport layer was formed as a film. A coating fluid for formation of the charge transport layer was prepared by dissolving 100 parts by weight of the organic compound of the aforementioned structural formula (2-47) as a charge transport material, and 100 parts by weight of a polycarbonate resin ("Toughzet B-500", Idemitsu Kosan) as a resin binder in 900 parts by weight of dichloromethane. This coating fluid was applied onto the charge generation film by dip coating, and dried for 60 minutes at a temperature of 90° C. to form a charge transport layer with a thickness of about 25 $\mu$m.

In the foregoing manner, an organic electrophotographic photoconductor was produced.

Example 2

An organic electrophotographic photoconductor was produced in the same manner as in Example 1, except that the charge generation material used in Example 1 was replaced by the titanyloxyphthalocyanine compound synthesized in the Synthesis Example 2 and having the X-ray diffraction spectrum shown in FIG. 4 (maximum peak at 2θ=27.3°±0.2°).

Comparative Example 1

Figure 5:
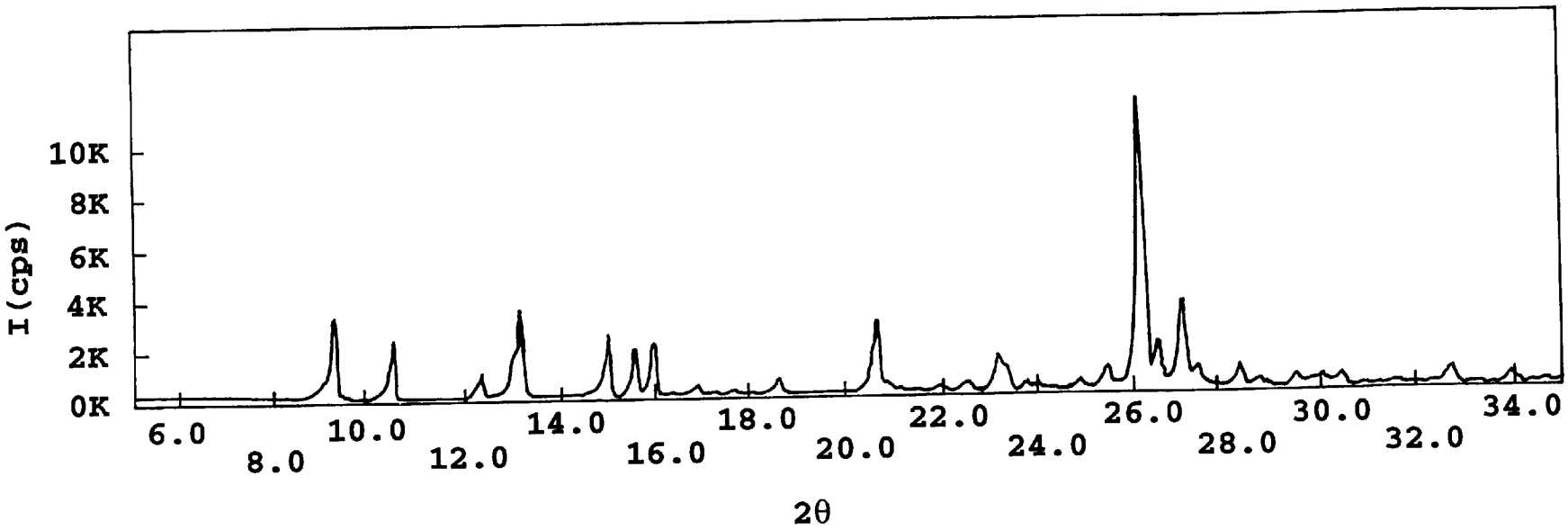
FIG. 5 shows the X-ray diffraction spectrum of β type titanyloxyphthalocyanine crystals described in Comparative Example 1.

An organic electrophotographic photoconductor was produced in the same manner as in Example 1, except that the charge generation material used in Example 1 was replaced by β type titanyloxyphthalocyanine having an X-ray diffraction spectrum as shown in FIG. 5 (the compound described in Japanese laied open Publication No. 62-67094).

Comparative Example 2

An organic electrophotographic photoconductor was produced in the same manner as in Example 1, except that the charge transport material used in Example 1 was replaced by a compound represented by the following formula (6)

(6)

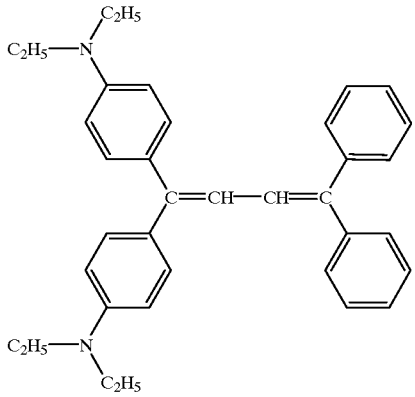

Comparative Example 3

An organic electrophotographic photoconductor was produced in the same manner as in Example 1, except that the charge transport material used in Example 1 was replaced by a compound represented by the following formula (7)

(7)

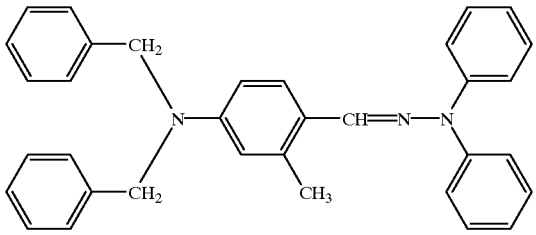

Each of the photoconductors produced as above was mounted on a digital copier, a reversal development type electrophotographic printer modified so that a transfer current can be arbitrarily turned on or off, and the surface potential of the photoconductor can be measured. The difference between the surface potential when the transfer current was ON, and the surface potential when the transfer current was OFF was measured.

Then, image formation tests were conducted with the actual use of sheets and in the constant ON state of transfer current, and the differences in printing density of halftone printing between the intersheet space and the sheet-existent portion were evaluated by eyes.

The results are shown in Table 1. In table 1, symbols, ◎, ○, Δ, and X, have the following meaning.

◎: Differences in printing density are not observed;

○: A little difference in printing density that is acceptable is observed.

Δ: Differences in printing density that are unacceptable is observed.

X: Distinct differences in printing density are observed.

TABLE 1

| | transfer current | | | results | | |
|---|---|---|---|---|---|---|
| | transfer current ON | transfer current OFF | potential difference | ordinary temp. and humidity*1 | higher temp. and humidity*2 | lower temp. and humidity*3 |
| example 1 | 778 V | 790 V | 12 V | ◎ | ○ | ◎ |
| example 2 | 770 V | 785 V | 15 V | ◎ | ○ | ◎ |
| comparative | 730 V | 783 V | 53 V | ○ | X | Δ |

TABLE 1-continued

| | transfer current | | | results | | |
|---|---|---|---|---|---|---|
| | transfer current ON | transfer current OFF | potential difference | ordinary temp. and humidity*1 | higher temp. and humidity*2 | lower temp. and humidity*3 |
| example 1 | | | | | | |
| comparative example 2 | 700 V | 780 V | 80 V | Δ | X | Δ |
| comparative example 3 | 685 V | 783 V | 98 V | X | X | X |

*1: temperature 25° C., humidity 60%
*2: temperature 35° C., humidity 90%
*3: temperature 5° C., humidity 10%

As demonstrated by the above results, the electrophotographic photoconductors of the present invention (Examples 1 and 2), in which titanyloxyphthalocyanine compounds of the aforementioned formula (1) and having a clear diffraction peak at 2θ=9.6°±0.2° or 2θ=27.3°±0.2° in an X-ray diffraction spectrum were each used as a charge generation material for the charge generation layer, and an organic compound of the aforementioned structural formula (2-47) was used as a charge transport material for the charge transport layer, had smaller differences in surface potential between the transfer current-ON state and the transfer current-OFF state, than the photoconductors of using other charge generation material (Comparative Examples 1) and other charge transport materials Comparative Examples 2 and 3). Furthermore, the electrophotographic photoconductors of the invention exhibited satisfactory characteristics free from printing density changes in the image formation tests.

Besides, even with various changes of the environment where the photoconductor was used, transfer memory was corrected with the electrophotographic photoconductors of the invention.

The present invention has been described in detail with respect to various embodiments, and it will now be apparent from the foregoing to those skilled in the art that changes and modifications may be made without departing from the invention in its broader aspects, and it is the intention, therefore, in the appended claims to cover all such changes and modifications as fall within the true spirit of the invention.

What is claimed is:

1. A separated-function laminated type organic electrophotographic photoconductor having an undercoat layer, a charge generation layer, and a charge transport layer on a conductive substrate, wherein:

said charge generation layer contains, as a charge generation material, a titanyloxyphthalocyanine compound of the following general formula (1), (1)

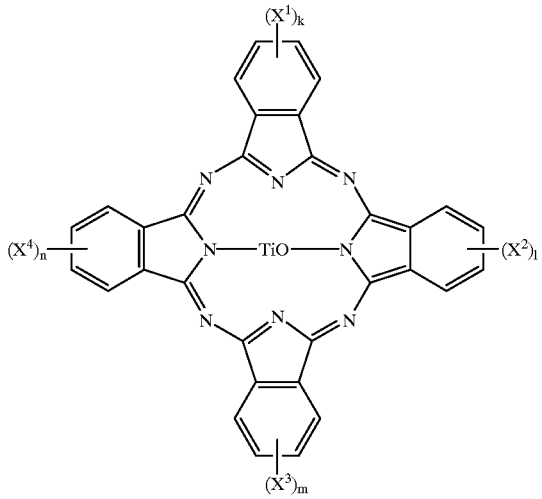

where $X^1$, $X^2$, $X^3$ and $X^4$ may be the same or different, and each represent a halogen atom, and k, l, m and n each represent 0, 1, 2, 3 or 4, said titanyloxyphthalocyanine compound having a clear diffraction peak at a Bragg angle (2θ) of 9.6°±0.2° or 27.3°±0.2° for CuKα characteristic X-ray (wavelength 1.541 Å); and said charge transport layer contains, as a charge transport material, an organic compound of the following general formula (2), (2)

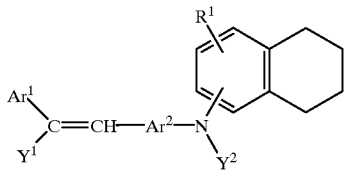

where $Ar^1$ represents an aryl group optionally having a substituent, $Ar^2$ represents an arylene group optionally having a substituent, $R^1$ represents a hydrogen atom, a lower alkyl group, or a lower alkoxy group, $Y^1$ represents a hydrogen atom, an alkyl group optionally having a substituent, or an aryl group optionally having a substituent, and $Y^2$ represents an aryl group optionally having a substituent.

2. The electrophotographic photoconductor of claim 1, wherein $Y^2$ in the general formula (2) is selected from the group consisting of:

a group of the formula (3)

(3)

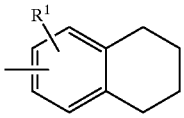

where $R^1$ is as defined in claim 1;

a group of the formula (4)

(4)

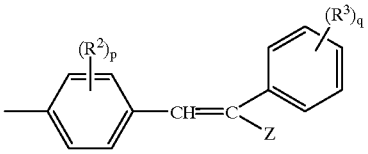

where $R^2$ represents a hydrogen atom, a lower alkyl group, or a lower alkoxy group, $R^3$ represents a hydrogen atom, a halogen atom, or a lower alkyl group, Z represents a hydrogen atom, or an aryl group optionally having a substituent, and p and q each represent 0, 1, 2, 3 or 4; and a group of the formula (5)

(5)

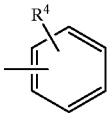

where $R^4$ represents a hydrogen atom, a lower alkyl group, a lower alkoxy group, an alkoxyalkyl group, a halogen atom, an aralkyl group, or an aryl group optionally having a substituent.

3. An electrophotographic device comprising a photoconductor, a charging means, an exposure means, a development means, a transfer means, a fixing means, a pre-exposure means, a cleaning means, and a recording medium supply means, wherein:

said photoconductor includes a conductive substrate, an undercoat layer, a charge generation layer, and a charge transport layer;

said charge generation layer contains, as a charge generation material, a titanyloxyphthalocyanine compound of the following general formula (1), (1)

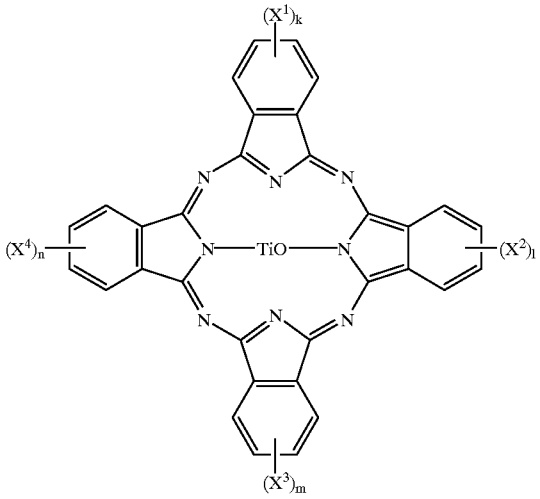

where $X^1$, $X^2$, $X^3$ and $X^4$ may be the same or different, and each represent a halogen atom, and k, l, m and n each represent 0, 1, 2, 3 or 4, said titanyloxyphthalocyanine compound having a clear diffraction peak at a Bragg angle (2θ) of 9.6°±0.2° or 27.3°±0.2° for CuKα characteristic X-ray (wavelength 1.541 Å); and said charge transport layer contains, as a charge transport material, an organic compound of the following general formula (2), (2)

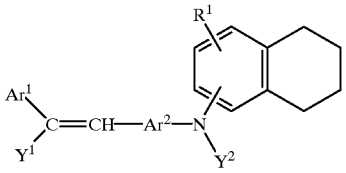

where $Ar^1$ represents an aryl group optionally having a substituent, $Ar^2$ represents an arylene group optionally having a substituent, $R^1$ represents a hydrogen atom, a lower alkyl group, or a lower alkoxy group, $Y^1$ represents a hydrogen atom, an alkyl group optionally having a substituent, or an aryl group optionally having a substituent, and $Y^2$ represents an aryl group optionally having a substituent.

4. The electrophotographic device of claim 3, wherein $Y^2$ in the general formula (2) is selected from the group consisting of:

a group of the formula (3)

(3)

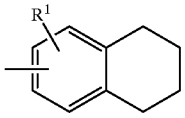

where $R^1$ is as defined in claim 3;

a group of the formula (4)

(4)

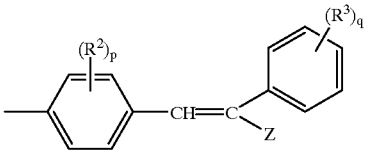

where $R^2$ represents a hydrogen atom, a lower alkyl group, or a lower alkoxy group, $R^3$ represents a hydrogen atom, a halogen atom, or a lower alkyl group, Z represents a hydrogen atom, or an aryl group optionally having a substituent, and p and q each represent 0, 1, 2, 3 or 4; and a group of the formula (5)

(5)

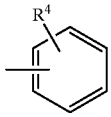

where $R^4$ represents a hydrogen atom, a lower alkyl group, a lower alkoxy group, an alkoxyalkyl group, a halogen atom, an aralkyl group, or an aryl group optionally having a substituent.

* * * * *